United States Patent [19]

Zenhausern

[11] Patent Number: 4,660,681

[45] Date of Patent: Apr. 28, 1987

[54] ANCHOR AND CLIMBING RUNG

[76] Inventor: Heinrich Zenhausern, Birmensdorferstrasse 134A, CH-8902, Urdorf/Zurich, Switzerland

[21] Appl. No.: 778,239

[22] Filed: Sep. 20, 1985

[51] Int. Cl.[4] ..... E06C 7/08

[52] U.S. Cl. ..... 182/90; 411/72; 411/510

[58] Field of Search ..... 182/90, 91, 92; 285/43, 285/46; 411/72, 510

[56] References Cited

U.S. PATENT DOCUMENTS

| | | | |
|---|---|---|---|
| 3,098,663 | 7/1963 | Dibley | 285/43 |
| 3,374,532 | 3/1968 | Zenhausern | 182/90 |
| 4,385,777 | 5/1983 | Logsdon | 285/46 |
| 4,570,943 | 2/1986 | Houseman | 285/43 |

FOREIGN PATENT DOCUMENTS

| | | | |
|---|---|---|---|
| 2440461 | 7/1980 | France | 182/90 |

*Primary Examiner*—Reinaldo P. Machado
*Attorney, Agent, or Firm*—James D. Fornari

[57] ABSTRACT

A u-shaped climbing rung to be anchored in a bore hole in a wall, the climbing rung being two parallel legs each leg having two ends, one end of each leg being connected to a transverse central element or tread spaced a predetermined distance below the parallel legs and having the other end for anchoring in a wall, the legs and tread being completely encapsulated in a synthetic protective coat having an outer configuration adapted to present each end of the legs remote the tread for anchoring the climbing rung in the wall, each encapsulated end having an anchor for anchoring the end of each leg, in a wall, and two soft elastic and tightly fitting sealing collars located on the legs spaced from the end of the legs securely anchored in the wall to frictionally slide along the legs to present a sealing face to an abutting wall deforming when abutting the surface of the wall to accommodate the surface configuration of the wall surrounding the bore hole whereby the combination of the anchor for securely anchoring the end of each leg in a wall and the sealing collar thereby preclude water and corrosive material from penetrating the bore hole.

3 Claims, 6 Drawing Figures

11
13
15
17
19
21
23
25
27
29
31
33
35
37
39
51
53

ANCHOR AND CLIMBING RUNG

FIELD OF THE INVENTION

The present invention relates to an improved anchor and climbing rung whereby the climbing rung may be anchored in pre-cast or cast in place concrete, masonry, brick work or the like.

BACKGROUND OF INVENTION

A variety of climbing rungs for anchoring to wall surfaces have been proposed employing a generally U-shaped rung consisting of two parallel legs for anchoring into a wall and spaced apart by a central element or tread.

For example in Canadian Letters Patent No. 716,881 (corresponding U.S. Pat. No. 3,374,532) I disclosed a process for making a rung whereby a flexible, synthetic plastics material sleeve is fitted over a straight length of metal tubing and the length of metal tubing sheathed in plastic is bent into a U-shape to form a climbing rung. Such a bending serves to stretch the plastics material sleeve so that it grips the metal tubing. The anchoring legs may then be permanently inserted into receptive bore holes in a wall.

In Canadian Letters Patent No. 936,845 I dealt with the risk of oxidation and rusting of the anchoring legs of a rung which are embedded in a wall. According to the invention disclosed a steel tube is bent into a U-shape to form a climbing rung and is covered with a non-corroding coating, for example of aluminum or plastics material. Both ends of the tubular rung are plugged. For each climbing rung two anchor sleeves corresponding to the ends of the rung are provided which are adapted to be located in suitably placed bore holes in a wall. The anchor sleeves, made from plastic or nylon are in the shape of a tubular shell having a slightly conical inner bore and are sealed at one end. When the ends of the rung are forced into the slightly conical inner bore of the anchor sleeve located in the bore holes in a wall, the anchor sleeve expands and is jammed very tightly into the bore hole.

The exposure of the ends of the rung to oxidation, rusting and corrosion is thereby mitgated. However, a tight seal at the overlap of the protective coating for the steel tube, such as the end of a jacket sleeve, with the respective anchor sleeve is not always ensured. In particular, use of the rung will result in flexion and vibration spreading corrosion materials between the anchor sleeve, protective jacket and steel tube advancing corrosion of the steel tube. This corrosion is not visible to inspection. In addition, water and corrosive materials may penetrate into the space between the outside surface of the sleeve and the bore hole, subjecting the bore hole which comprises the portion of the wall surrounding the anchor sleeve to chemical disintegration.

One solution to the problem of water and corrosive substances penetrating the spaces between the anchor sleeve, protective jacket and steel tube has been to bend a climbing rung, made of steel tubing or steel reinforcing rod to the desired configuration and then to encapsulate it in a corrosion resistant material such as recovered battery case material by means of an injection moulding process. The protective jacket thereby surrounds the preformed inner reinforcement effectively sealing it against corrosion. The ends of this type of step comprising anchoring projections may be driven directly into bore holes in a wall. However, the bore hole is still subject to penetration by water or corrosive substances.

It is therefore an object of this invention to provide an improved anchor and climbing rung which may be anchored in a wall without thereby exposing the wall at the anchoring site to permeation or penetration by water or corrosive substances.

Further and other objects of the invention will be apparent to those skilled in the art from the following summary of the invention and detailed description of preferred embodiments thereof.

SUMMARY OF INVENTION

According to one aspect of the invention there is provided a U-shaped climbing rung to be anchored in a bore hole in a wall, the climbing rung comprising two parallel legs each leg having two ends one end of each leg being connected to a transverse central element or tread preferably spaced a predetermined distance below the parallel legs, and having the other end for anchoring in a wall, the legs and tread being encapsulated in a synthetic protective coat having an outer configuration adapted to present each end of the legs remote the tread for anchoring the climbing rung in the wall, each encapsulated end having a conical end and a plurality of spaced annular fin configurations surrounding the end of the leg adjacent the conical end, the spaced annular fin configurations having a shape angularily sloped radially inward towards the conical end and in the direction of insertion of the end of the leg, and an oblique surface remote the angularily sloped surface, each encapsulated end comprising in combination a first set of annular fin configurations which are sub-divided into sector shaped segments in fish scale fashion having intermediate gaps between each segment, the adjacent fins being staggered with respect to each other so that the gaps between segments are staggered such that the first set of sub-divided annular fins frictionally lock the encapsulated end in a bore hole when inserted, a second set of annular fin configurations which are not sub-divided and are remote the conical end of each leg of an outside diameter slightly greater than that of the first set of sub-divided annular fin configurations, and two soft elastic and tightly fitting sealing collars located on the legs spaced from the end of the fins and the legs to frictionally slide along the legs to present a sealing face to an abutting wall deforming when abutting the surface of the wall to accommodate the surface configuration of the wall surrounding the bore hole whereby the combination of the second set of annular fin configurations and the sealing collar thereby preclude water and corrosive material from penetrating the bore hole.

According to a preferred embodiment of the invention the U-shaped climbing rung comprises two parallel legs each leg having two ends, one end of each leg being spaced apart by a central element or tread spaced a predetermined distance below the parallel legs, the legs being connected to the tread piece by a pair of connecting arms extending between each end of the tread piece and one end of each leg, whereby the connecting arms provide a guard against a user's foot slipping off the side of the tread and provide a surface which may be struck when the climbing rung legs are driven into bore holes. According to this embodiment of the invention the connecting arms extend perpendicular to the axis of the climbing rung legs such that when the climbing rung is anchored in a wall the connecting arms are disposed in a plane parallel to the wall thereby providing a surface which may be struck in order to drive the legs for anchoring the climbing rung directly into the bore holes. Preferably the synthetic protective coat encapsulating the climbing rung is of an outer configuration encapsulating the connecting arms to present a flat surface which may constitute a flat striking surface for hammer blows contact for anchoring the climbing rung.

According to a preferred embodiment of the invention the outer configuration of the synthetic protective coat encapsulating the climbing rung proximate the portion of the climbing rung where the anchoring legs exit the bore holes, presents alternating raised rings and annular grooves which correspond to rings and grooves on the inside surface of the collars that slide over the legs, whereby a frictional fit is established to enable the collar to be securely positioned to abut the surface of the wall where the legs exit the bore holes.

The invention will now be illustrated with reference to the following drawings of an embodiment of the invention and detailed description thereof.

DESCRIPTION OF PREFERRED EMBODIMENT OF THE INVENTION

Figure 1:
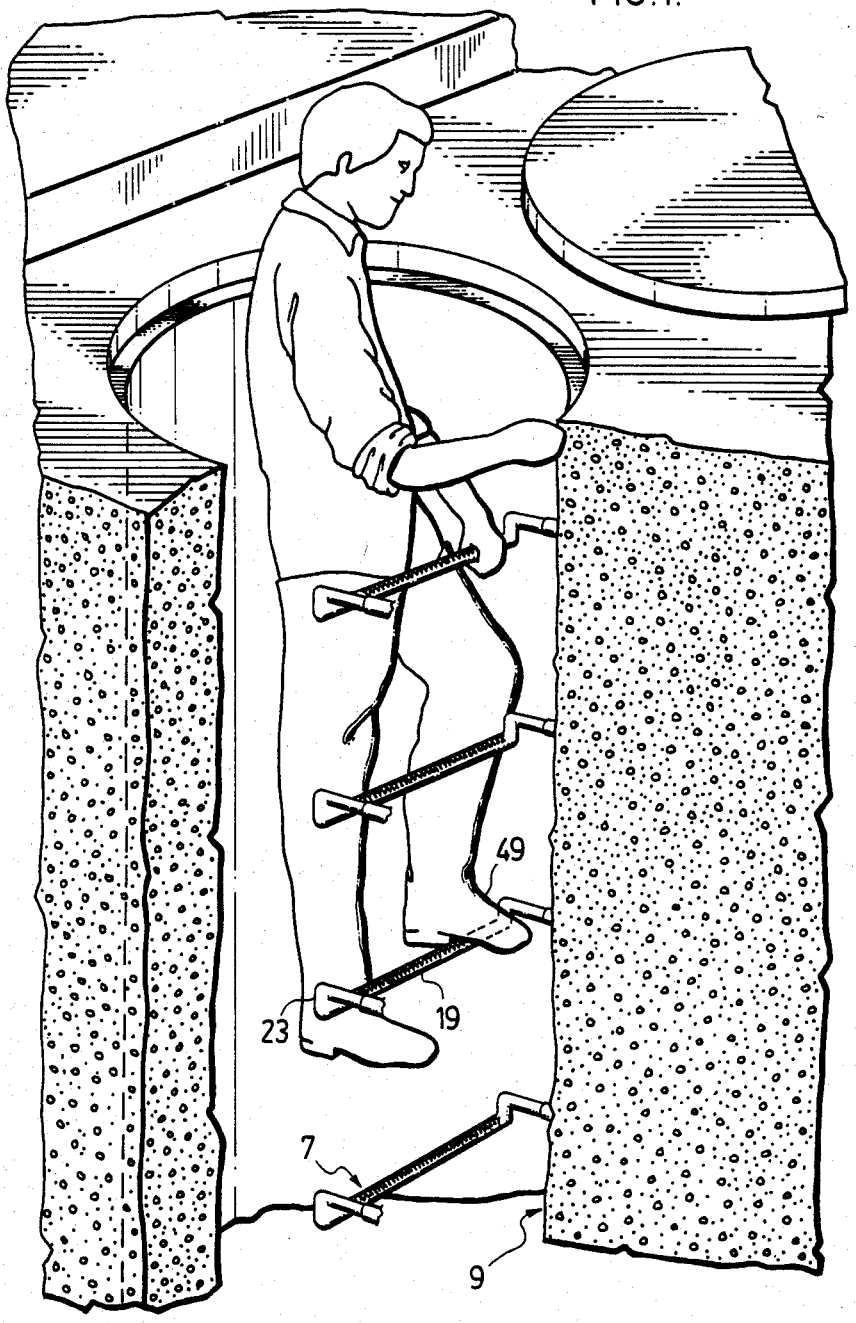
FIG. 1 is a perspective, partially cut away view of climbing rungs anchored in a vertical shaft.

With reference to FIG. 1 there is shown a plurality of climbing rungs 7 anchored in a vertical shaft or wall 9.

Figures 2, 3:
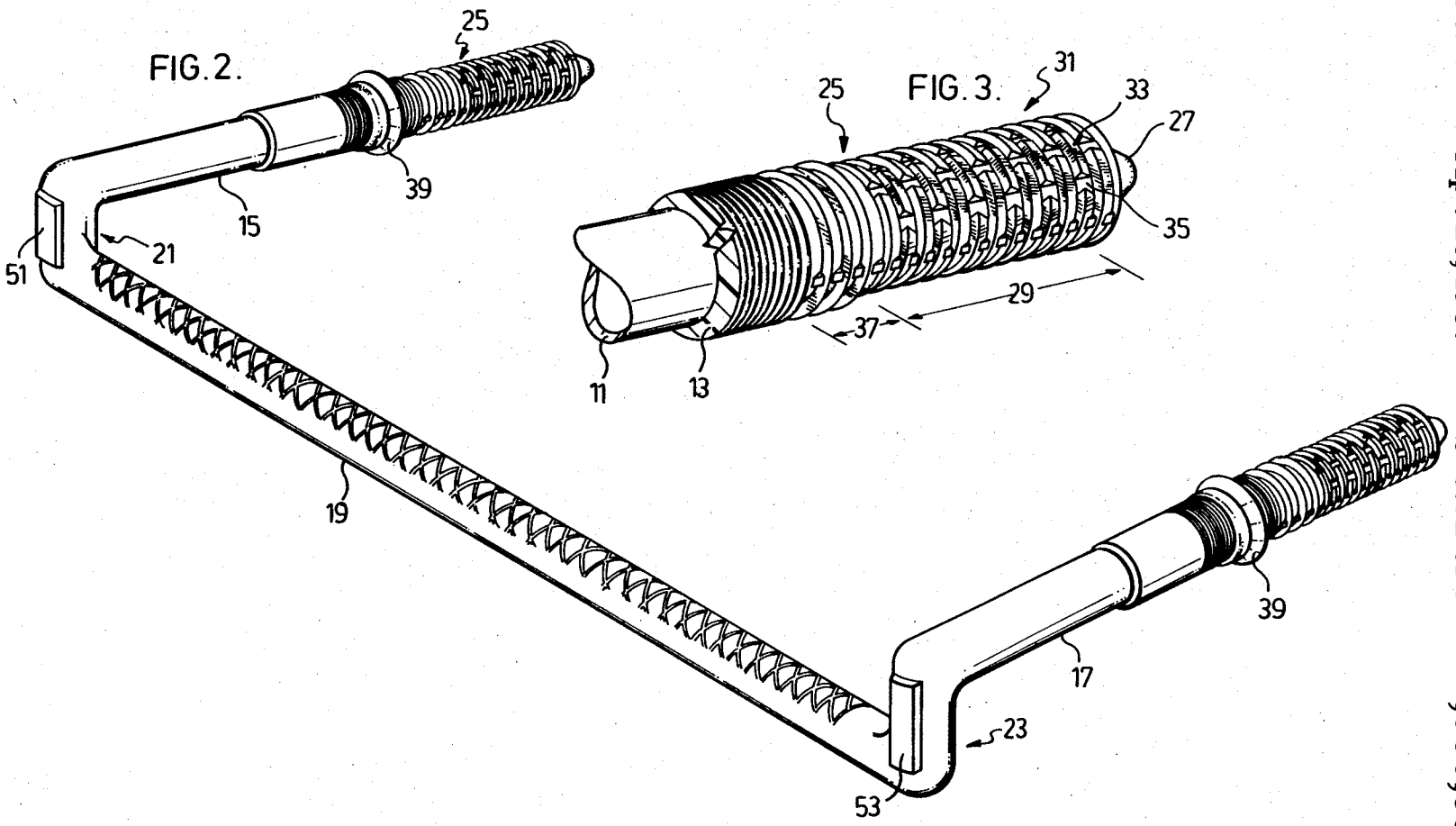
FIG. 2 is a perspective view of a climbing rung.
FIG. 3 is a close up, partially cut away view, of part of the climbing rung in FIG. 2.
Figure 4:
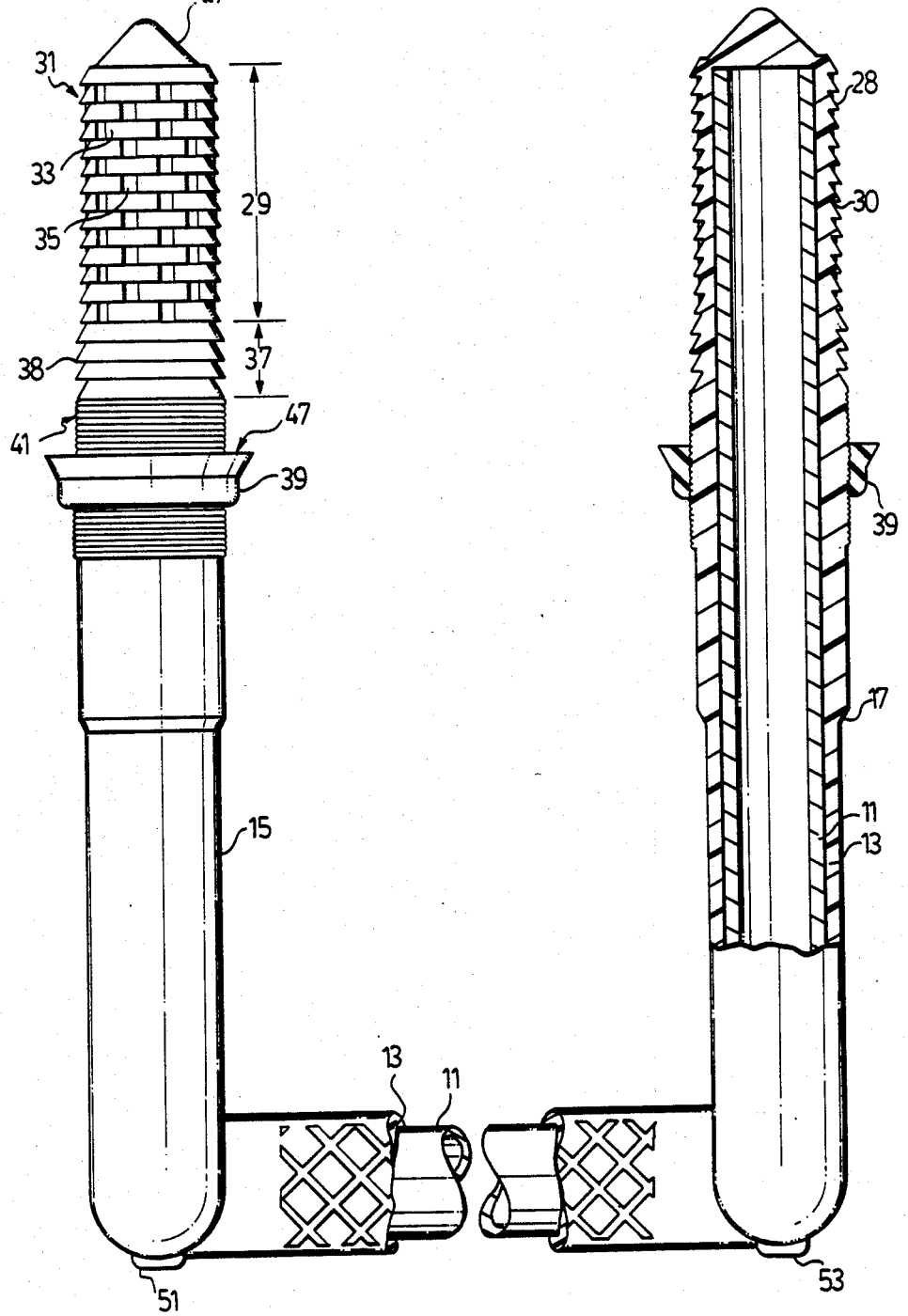
FIG. 4 is a top view of the climbing rung depicted in FIG. 2, part of which is viewed in longitudinal section

Referring generally to FIGS. 2, 3 and 4, the climbing rung comprises a central metal core 11 encapsulated in a synthetic protective coat 13 of corrosion resistant plastic, for example recovered battery case material, by means of an injection moulding process. Parallel legs 15, 17 are spaced apart by a central tread 19 which is spaced a predetermined distance below the legs 15, 17 by a pair of connecting arms 21, 23. Each leg 15, 17 comprises an encapsulated end 25 (best seen in FIG. 3). Each encapsulated end 25 has a conical end 27, and a plurality of spaced annular fin configurations, which are sloped radially inward 28 towards the conical end 27 and have an oblique surface 30 remote the angularily sloped surface 28, surrounding the encapsulated end 25 adjacent the conical end 25. With particular reference to FIGS. 3 and 4, the encapsulated end 25 comprises a first band 29 of annular fin configurations 31 subdivided into sector shaped segments 33 in fish-scale fashion, having intermediate gaps 35 between each segment 33. A second band 37 of annular fin configurations are not subdivided and are of a diameter slightly greater 38 than that of the first band 29. Two soft elastic and tightly fitting sealing collars 39 fit over each encapsulated end 25 behind the second band of annular fins 37. The encapsulated end 25 presents alternating raised rings and annular grooves 41 (best seen in FIG. 6) which correspond to annular rings and grooves 43 on the inside surface of the sealing collars 39.

Figure 5:
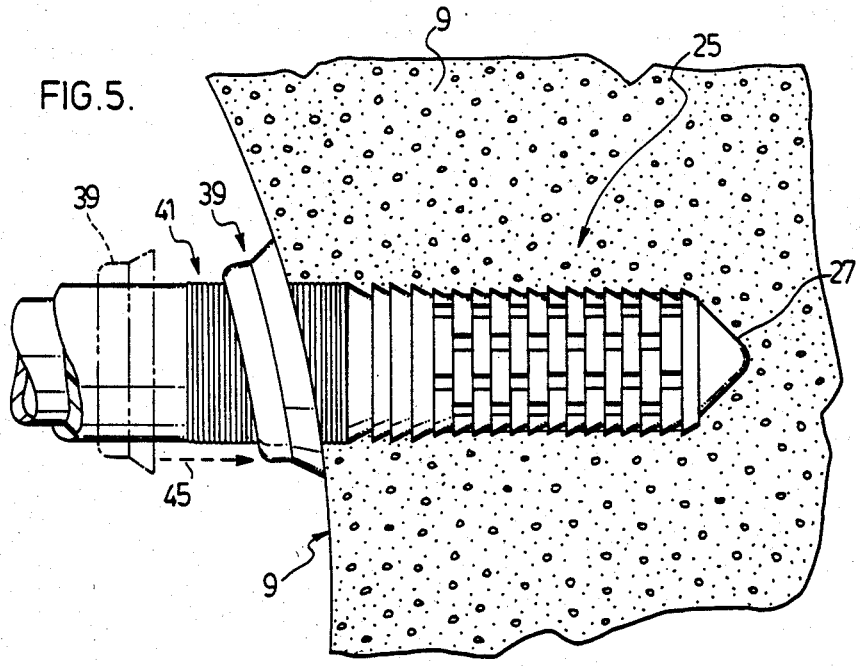
FIG. 5 is a top view of a leg of a climbing rung inserted in a bore hole.
Figure 6:
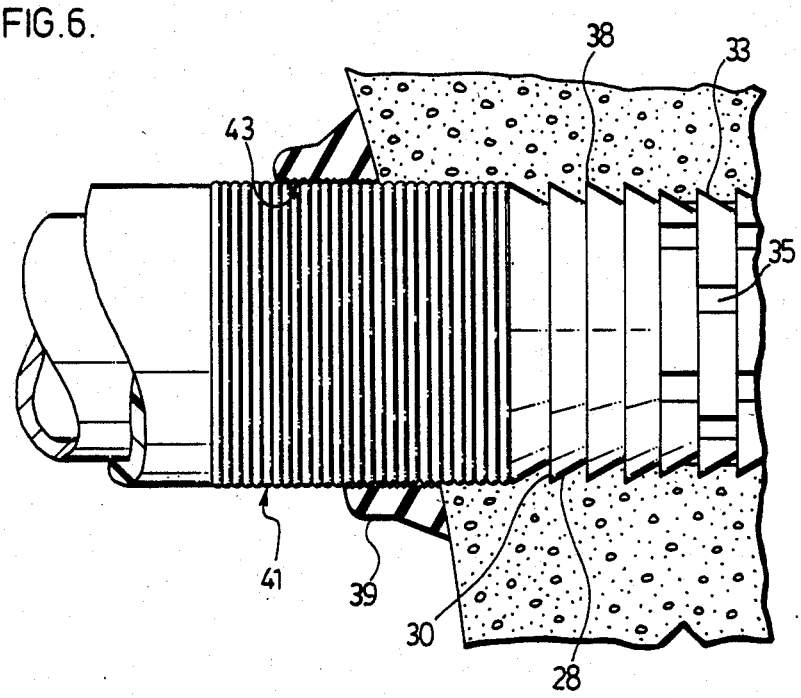
FIG. 6 is a close up of part of the view in FIG. 5, a portion of which view is in longitudinal section.

With particular reference to FIGS. 5 and 6 there is shown an encapsulated end 25 of a climbing rung leg 15, 17 anchored in a bore hole, depicted as the material of the wall 9 surrounding the encapsulated end 25. The sealing collar 39 is frictionally slide 45 along the alternating raised rings and grooves 41 to present a sealing face 47 (best depicted in FIG. 4) to the face of the wall 9 surrounding the bore hole. The combination of the second band of annular fins 37 of a diameter 38 slightly greater than that of the first band 29 and the sealing face 47 of the sealing collar 39 preclude water and corrosive material from penetrating the bore hole (depicted as the material 9 surrounding the encapsulated end 25). With reference to FIG. 6 the soft elastic composition of the sealing collar 39 (viewed in longitudinal section) permits it to conform to the irregularities or the radius of curvature of the wall 9 proximate the area where the collar abuts the wall 9.

With reference to FIGS. 1 and 2, the connecting arms 21, 23 provide a guard against a user's foot 49 slipping off the side of the tread 19. The connecting arms 21, 23 extend perpendicular to the axis of the parallel legs 15, 17 such that when the climbing rung 7 is anchored in the wall 9 the connecting arms 21, 23 are disposed in a plane parallel to the wall 9. The connecting arms present flat striking surfaces 51, 53 (seen in FIGS. 2 and 4) oriented in a plane parallel to the wall 9, so that the force of hammer blows on the striking surfaces 51, 53 will be directed in the longitudinal axis of the legs 15, 17, anchoring the encapsulated ends 25 in a bore hole.

As many changes can be made to the embodiment of the invention without departing from the scope of the invention, it is intended that all material be considered as illustrative of the invention and not in a limiting sense.

The embodiments of the invention in which an exclusive property or privilege is claimed are as follows:

1. A u-shaped climbing rung to be anchored in a bore hole in a wall, the climbing rung comprising two parallel legs each leg having two ends, one end of each leg being connected to a transverse central element or tread spaced a predetrmined distance below the parallel legs and having the other end for anchoring in a wall, the legs and tread being completely encapsulated in a synthetic protective coat having an outer configuration adapted to present each end of the legs remote the tread for anchoring the climbing rung in the wall, each encapsulated end having means for anchoring the end of each leg in a wall comprising an end portion, and a raised annular configuration remote each end of an outside diameter slightly greater than the outside diameter of each encapsulated end proximate the end portion and two soft elastic and tightly fitting sealing collars located on the legs spaced from the end of the legs securely anchored in the wall to frictionally slide along the legs to present a sealing face to an abutting wall deforming when abutting the surface of the wall to accommodate the surface configuration of the wall surrounding the bore hole whereby the combination of the means for securely anchoring the end of each leg in a wall and the sealing collar thereby preclude water and corrosive material from penetrating the bore hole.

2. A u-shaped climbing rung to be anchored in a bore hole in a wall, the climbing rung comprising two parallel legs each leg having two ends, one end of each leg being connected to a transverse central element or tread spaced a predetermined distance below the parallel legs and having the other end for anchoring in a wall, the legs and tread being completely encapsulated in a synthetic protective coat having an outer configuration adapted to present each end of the legs remote the tread for anchoring the climbing rung in the wall, each encapsulated end having a conical end and a plurality of spaced annular fin configurations surrounding the end of the leg adjacent the conical end, the spaced annular fin configurations having a shape angularily sloped radially inward towards the conical end and in the direction of insertion of the end of the leg, and an oblique surface remote the angularily sloped surface, each encapsulated end comprising in combination a first set of annular fin configurations which are sub-divided into sector shaped segments in fish-scale fashion having intermediate gaps between each segment, the adjacent fins being staggered with respect to each other so that the gaps between segments are staggered such that the first set of sub-divided annular fins frictionally lock the encapsulated end in a bore hole when inserted, a second set of annular fin configurations which are not sub-divided and are remote the conical end of each leg of an outside diameter slightly greater than that of the first set of sub-divided annular fin configurations, and two soft elastic and tightly fitting sealing collars located on the legs spaced from the end of the fins and the legs to frictionally slide along the legs to present a sealing face to an abutting wall deforming when abutting the surface of the wall to accommodate the surface configuration of the wall surrounding the bore hole whereby the combination of the second set of annular fin configurations and the sealing collar thereby preclude water and corrosive material from penetrating the bore hole.

3. The u-shaped climbing rung of claim 2 wherein the two parallel legs each leg having two ends, one end of each leg being connected to a transverse central element or tread spaced a predetermined distance below the parallel legs, are connected to the tread piece by a pair of connecting arms extending between each end of the tread piece and one end of each leg, whereby the connecting arms extend perpendicular to the axis of the climbing rung legs and present a synthetic protective coat encapsulating the climbing rung proximate the connecting arms of an outer configuration to present a flat surface such that when the climbing rung is anchored in a wall the connecting arms are disposed in a plane parallel to the wall and present a flat surface which may be struck in order to drive the legs for anchoring the climbing rung directly into the bore holes.

* * * * *

UNITED STATES PATENT AND TRADEMARK OFFICE

CERTIFICATE OF CORRECTION

PATENT NO. : 4,660,681

DATED : April 28, 1987

INVENTOR(S) : Heinrich Zenhausern

It is certified that error appears in the above-identified patent and that said Letters Patent is hereby corrected as shown below:

In column 1 of the Patent at line 44 after 'thereby' and before '.', the word "mitgated" has been struck and the word ---mitigated--- substituted therefor;

In column 2 of the Patent at line 29 after 'shape' and before 'sloped', the word "angularily" has been struck and the word ---angularly--- substituted therefor;

In column 2 of the Patent at line 32 after 'the' and before 'sloped', the word "angularily" has been struck and the word ---angularly--- substituted therefor;

In column 3 of the Patent at line 53 after 'the' and before 'sloped', the word "angularily" has been struck and the word ---angularly--- substituted therefor;

In column 4 of the Patent at line 5 after 'frictionally' and before '45', the word "slide" has been struck and the word ---slid--- substituted therefor;

UNITED STATES PATENT AND TRADEMARK OFFICE

CERTIFICATE OF CORRECTION

PATENT NO. : 4,660,681

DATED : April 28, 1987

INVENTOR(S) : Heinrich Zenhausern

It is certified that error appears in the above-identified patent and that said Letters Patent is hereby corrected as shown below:

In column 4 of the Patent at line 42 after 'a' and before 'distance', the word "predetrmined" has been struck and the word ---predetermined--- substituted therefor;

In column 5 of the Patent at line 8 after 'shape' and before 'sloped', the word "angularily" has been struck and the word ---angularly--- substituted therefor;

In column 5 of the Patent at line 11 after 'the' and before 'sloped', the word "angularily" has been struck and the word ---angularly--- substituted therefor.

Signed and Sealed this

Twenty-seventh Day of October, 1987

*Attest:*

DONALD J. QUIGG

*Attesting Officer*

*Commissioner of Patents and Trademarks*